US005297787A

United States Patent [19]

Shirai

[11] Patent Number: 5,297,787

[45] Date of Patent: Mar. 29, 1994

[54] SHEET CASSETTE

[75] Inventor: Masami Shirai, Saitama, Japan

[73] Assignee: Asahi Kogaku Kogyo Kabushiki Kaisha, Tokyo, Japan

[21] Appl. No.: 24,497

[22] Filed: Mar. 1, 1993

[30] Foreign Application Priority Data

Feb. 27, 1992 [JP] Japan ..... 4-018414[U]

[51] Int. Cl.[5] ..... B65H 1/00

[52] U.S. Cl. ..... 271/171; 271/223

[58] Field of Search ..... 271/171, 223

[56] References Cited

U.S. PATENT DOCUMENTS 4,607,834 8/1986 Dastin ..... 271/171

4,697,803 10/1987 Kan et al. ..... 271/171

5,172,903 12/1992 Haneda et al. ..... 271/171

FOREIGN PATENT DOCUMENTS 0038226 2/1990 Japan ..... 271/171

3-133837 6/1991 Japan ..... 271/171

*Primary Examiner*—H. Grant Skaggs

*Attorney, Agent, or Firm*—Sandler, Greenblum & Bernstein

[57] ABSTRACT

A sheet cassette is provided with an adjustable paper storage area capable of accommodating multiple paper sizes, through the adjustment of a guide plate. The adjustment of one set of guide plates automatically adjusts the other guide plate pair, which moves in a perpendicular direction.

9 Claims, 9 Drawing Sheets

SHEET CASSETTE

BACKGROUND OF THE INVENTION

The present invention relates to a sheet cassette provided for accommodating cut sheets therein.

It is known that an imaging apparatus such as a copying machine, printer, facsimile or the like, forms images on respective cut sheets of various sizes, e.g., A4 size, letter size and legal size etc. Usually in such an imaging apparatus, in order to facilitate forming images on cut sheets of various sizes, a removable sheet cassette is used. One sheet cassette accommodates cut sheets of a predetermined size and is inserted into the apparatus. Accordingly, images can be formed on cut sheets of the desired size by inserting the sheet cassette that has the required cut sheet.

Since one sheet cassette accommodates only one size of cut sheets, however, the number of sheet cassettes required is equal to the number of sizes of different cut sheets being used.

SUMMARY OF THE INVENTION

It is therefore an object of the invention to provide an improved sheet cassette capable of accommodating various sizes of cut sheets.

In order to accomplished the above-mentioned object, according to a first aspect of the present invention, there is provided a sheet cassette, for accommodating cut sheets, detachably coupled to an apparatus. The sheet cassette includes a cassette body in which the cut sheet are accommodated. The uppermost one of the cut sheets is successively picked up to the apparatus in a predetermined pick up direction. First wall means for regulating the trailing edge of the cut sheet relative to the predetermined pick up direction are provided. The first wall means is movable in the pick up direction. Second wall means for regulating both side edges of the cut sheets in the predetermined pick up direction is provided, with second wall means being movable in a direction perpendicular to the pick up direction. Interconnecting means for interconnecting the movement of the first wall means with that of the second wall means in a predetermined relation is also provided.

According to a second aspect of the present invention, there is provided a sheet cassette, for accommodating cut sheets, detachably coupled to an apparatus. The sheet cassette includes a cassette body in which the cut sheet are accommodated, with the uppermost one of the cut sheets being sucessively picked up to the apparatus in a predetermined pick up direction. The sheet cassette further includes, first blocking means for blocking the movement of the cut sheets in a direction opposite to the predetermined pick up direction, movable with respect to the cassette body, and first restricting means for restricting the movement of the first blocking means in the predetermined pick up direction. The sheet cassette also includes second blocking means for blocking the movement of the cut sheets in a direction perpendicular to the predetermined pick up direction, movable with respect to the cassette body, second restricting means for restricting the movement of the second blocking means in the perpendicular direction, and interconnecting means for interconnecting the movement of the first blocking means with that of the second blocking means in a predetermined relation.

According to a third aspect of the present invention, there is provided a sheet cassette, for accommodating cut sheets, detachably coupled to an apparatus. The sheet cassette includes, a cassette body in which the cut sheet are accommodated, with the uppermost one of the cut sheets being successively picked up to the apparatus in a predetermined pick up direction, and first positioning means for positioning the trailing edge of the cut sheet relative to the predetermined pick up direction. The first positioning means is movable in the pick up direction. The sheet cassette further includes second positioning means for positioning both side edges of the cut sheets in the predetermined pick up direction, with the second positioning means being movable in a direction perpendicular to the pick up direction, and interconnecting means for interconnecting the movement of the first positioning means with that of the second positioning means in a predetermined relation.

The above and other objects, features and advantages of the present invention will become apparent from the following detailed description which is to be read in conjunction with the accompanying drawings.

BRIEF DESCRIPTION OF THE ACCOMPANYING DRAWINGS

DESCRIPTION OF THE EMBODIMENT

Figure 1:
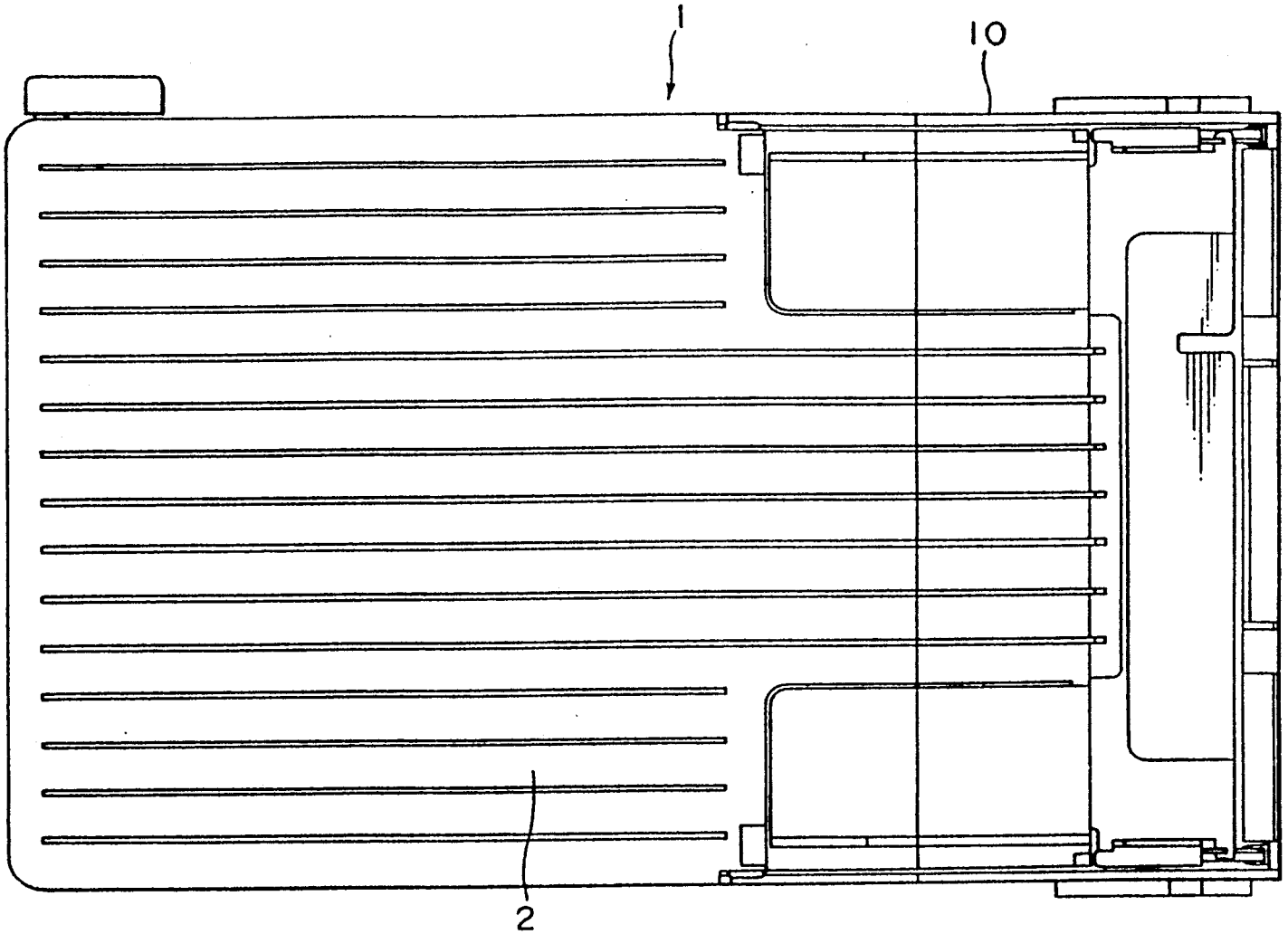
FIG. 1 is a top view of the sheet cassette of one embodiment according to the present invention.
Figure 2:
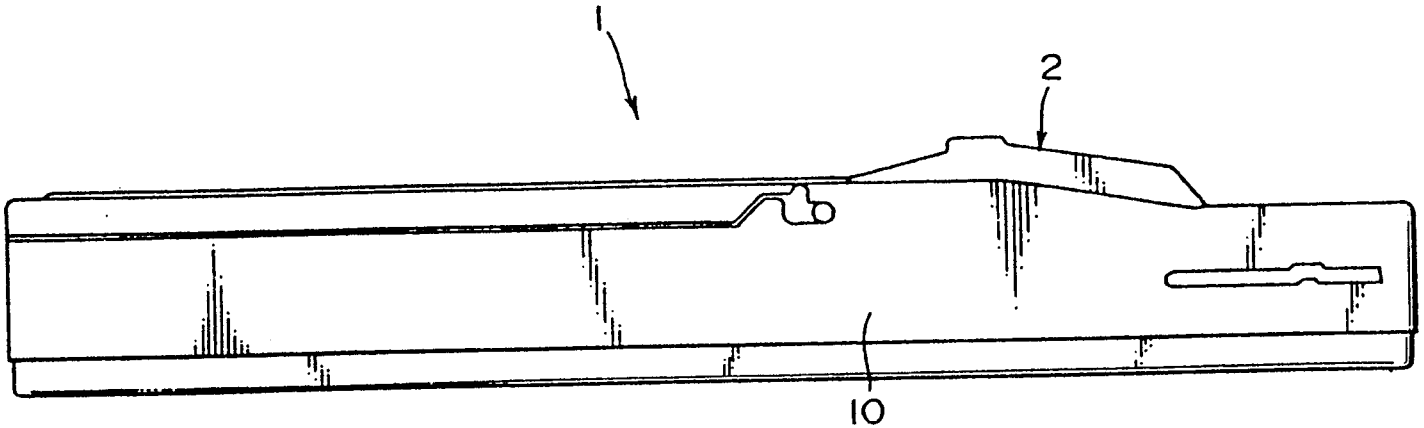
FIG. 2 is a side view of the sheet cassette shown in FIG. 1.

FIGS. 1 and 2 show top and side views respectively, of a sheet cassette 1 embodying the present invention. The sheet cassette 1 is provided with a container 10 for accommodating cut sheets, guide plates and other hardware (all not shown in FIG. 4) and a cover 2 for covering the container 10. The container 10 is shaped as a rectangular box in order to accommodate various size of cut sheets, for example, A4 size, letter size and legal size. The container 10 has enough height to accommodate many cut sheets therein. The cut sheets are placed on a plate 40 and accommodated in a space surrounded by first walls 22 of a trailing end positioning plate 20 and second walls 32 of a pair of side edge positioning plates 30, and a wall 10A of the container 10, and fed in a feed or picked up direction.

Figure 3:
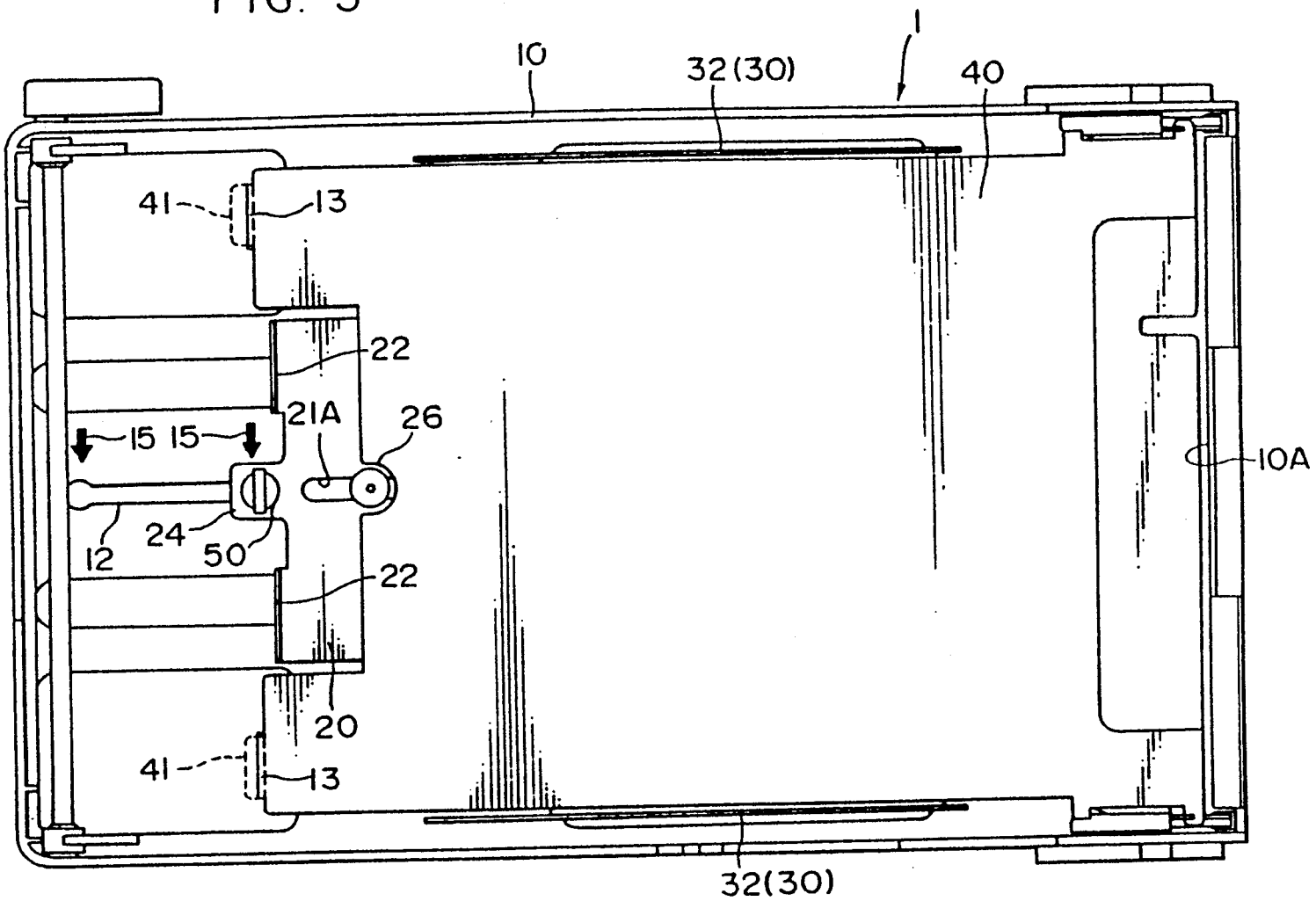
FIG. 3 is a top view of the inside of the sheet cassette (top cover removed)
Figure 4:
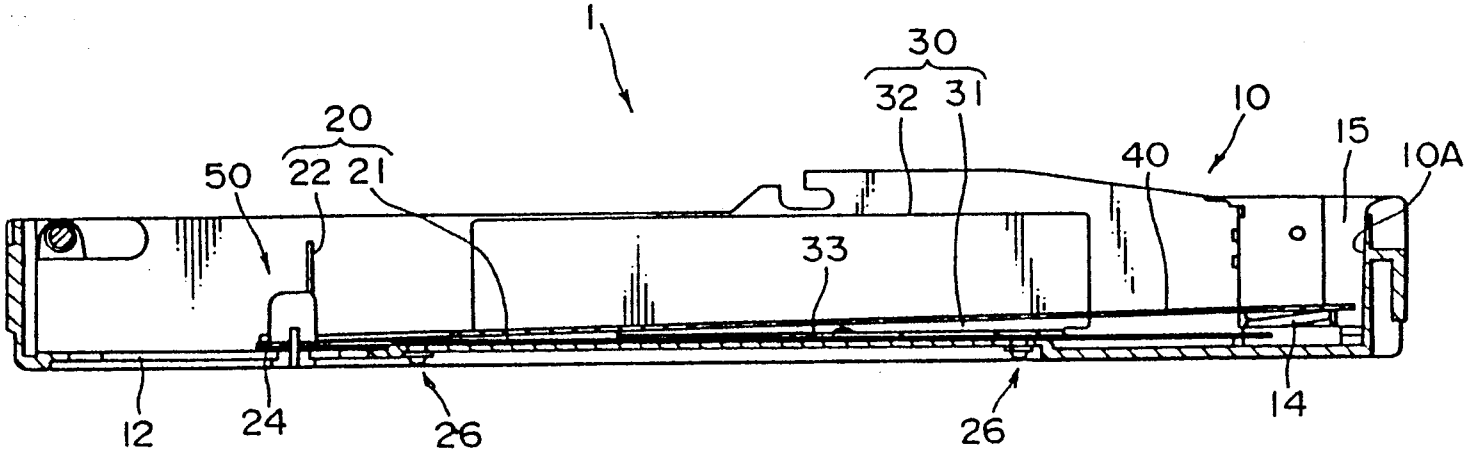
FIG. 4 is a cross-sectional side view of the sheet cassette.
Figure 5:
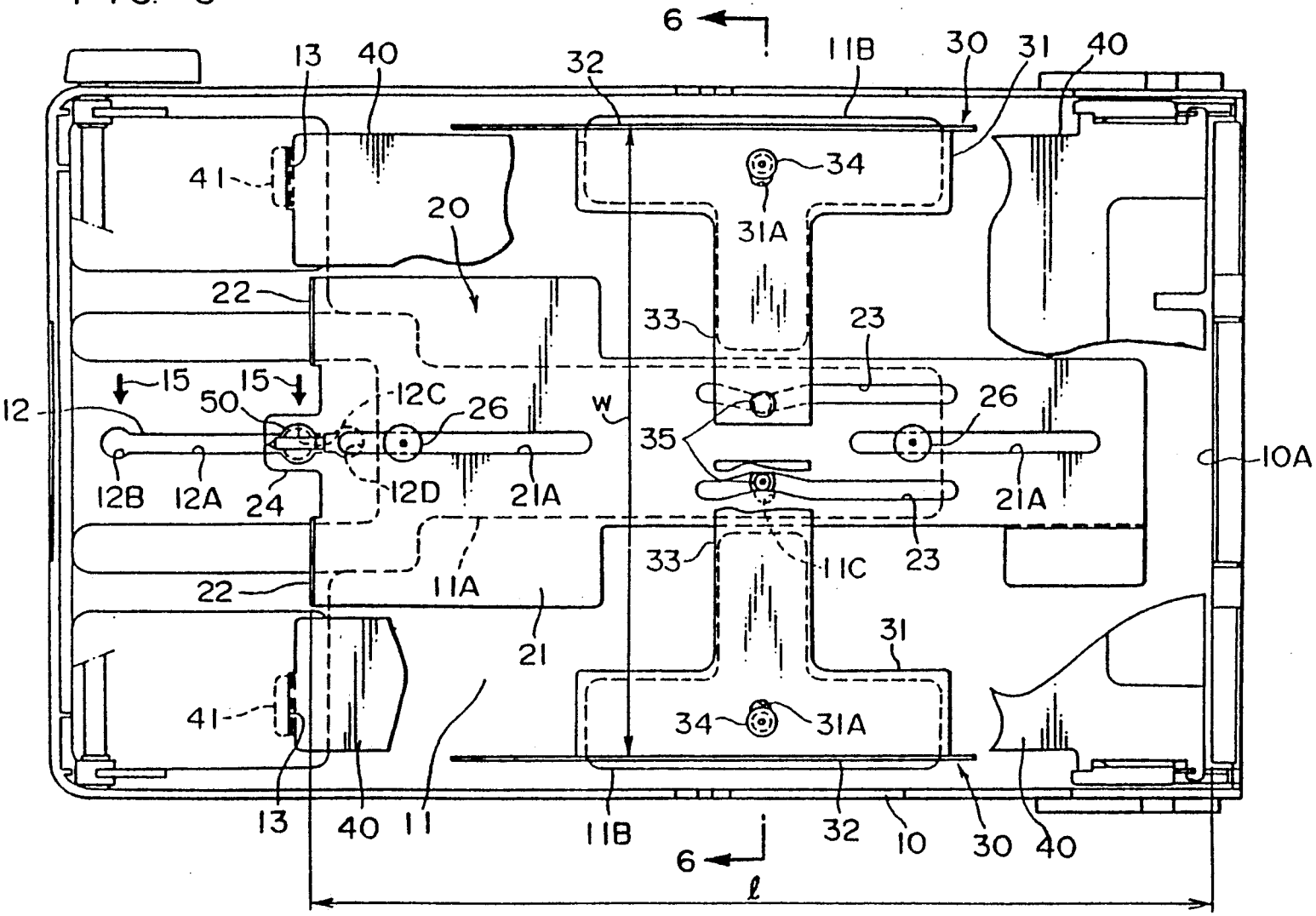
FIG. 5 is a top view of the sheet cassette with the top plate partially cut away.

FIGS. 3 and 4 show top and side views of the container 10, respectively, where the cover 2 is removed. The plate 40 is hinged, so as to be movable in a predetermined direction transverse to the feeding direction of the cut sheets, to a bottom plate 11 of the container 10 by two protrusions 41. The protrusions 41 are formed at the end of the plate 40, and inserted into holes 13 formed on the bottom plate 11. Between the bottom surface of the unhinged end of the plate 40 and the upper surface of the bottom plate 11, as shown in FIG. 4, spring 14 is provided so that the plate 40 is pushed away from the bottom plate 11. FIG. 5 shows a top view of the container 10 with the plate 40 partly cut away.

The plate 20 is provided for guiding the trailing end of the cut sheet and placed on the bottom plate 11, movably relative to the container 10 and has two first walls 22, a base section 21, and an end section 24. The first walls 22 are formed at right angles to the base section 21, at the end of the base section 21, and extend in a direction perpendicular to the feeding direction. The trailing ends of the cut sheets are contacted or supported by the first walls 22. The first walls 22 have enough height to accommodate many cut sheets, and blocks the movement of the cut sheets in a direction opposite to that where the cut sheets are fed from the sheet cassette 1 into the apparatus (as indicated in arrowed direction D shown in FIG. 5).

The direction where the plate 20 can be moved is determined as follows. Two guide slits 21A are formed on the base section 21 in the feeding direction D. Pins 26 are fixed to the bottom plate 11 and inserted in the guide slits 21A. Furthermore, the base section 21 is mounted on a guide flange 11A formed on the upper surface of the bottom plate 11. These permit the movement of the plate 20 in the direction D, or the direction opposite to the direction D, but prohibit the movement in the direction perpendicular to the direction D,. The movable range of the plate 20 in the direction D relative to the bottom plate 11, is determined in accordance with the length of the guide slit 21A. Note that the pin 26 and the guide slit 21A constitute a first restricting means of the present invention.

Figure 8:
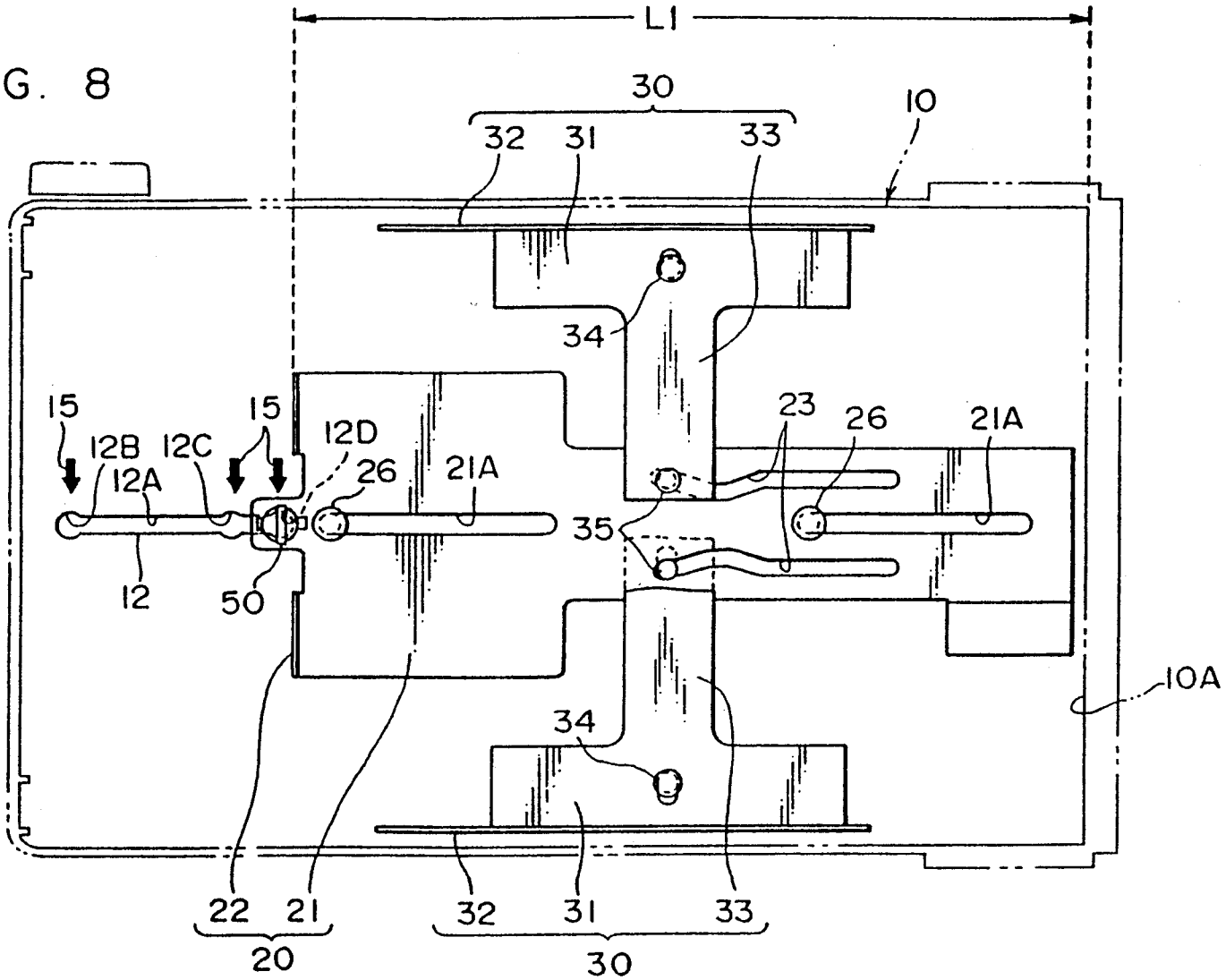
FIG. 8 is a simplified top view of the sheet cassette, with the guide plates set for the largest paper size.
Figure 9:
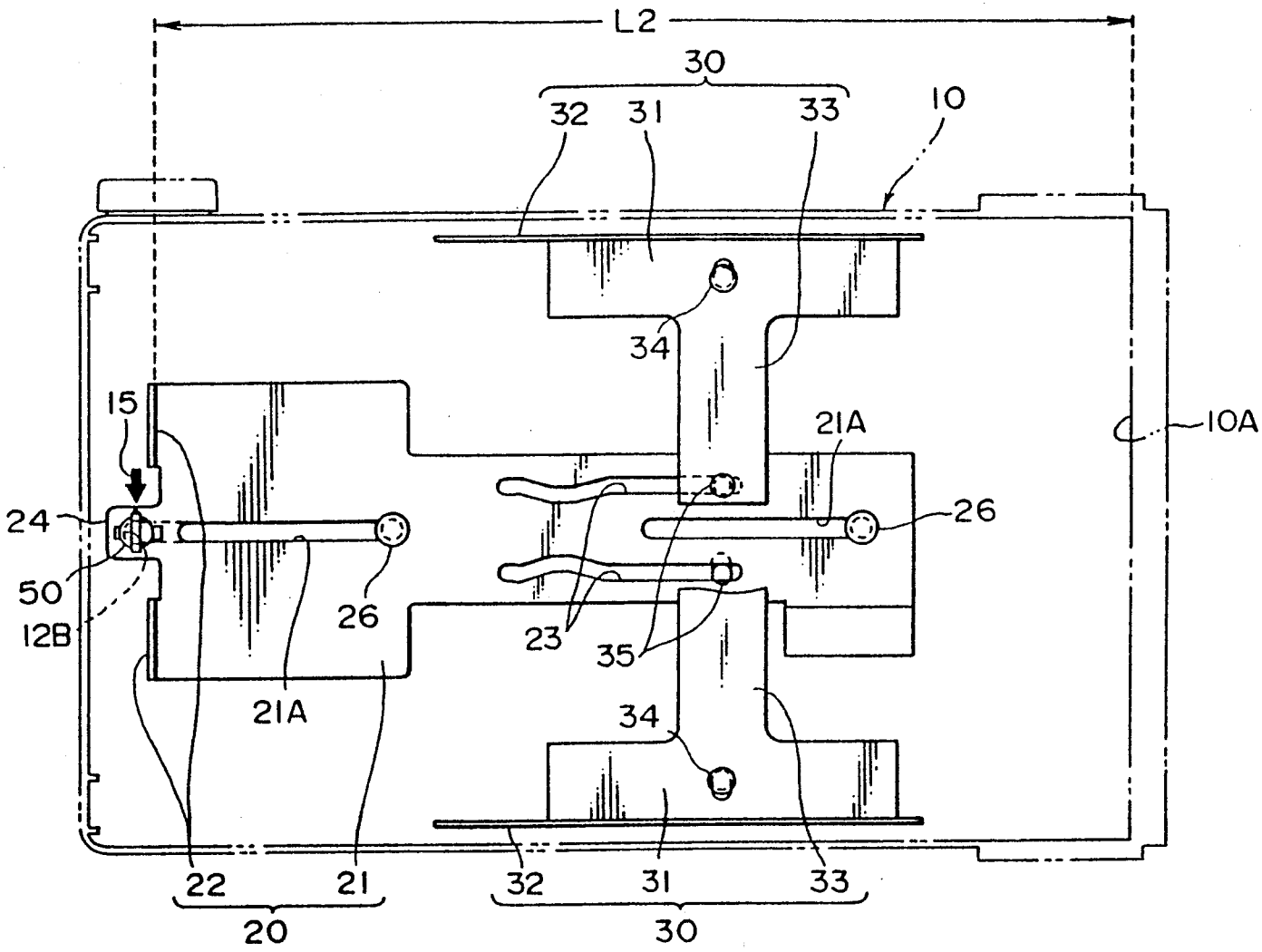
FIG. 9 is a simplified top view of the sheet cassette, with the guide plates set for the smallest paper size.

FIG. 8 shows the position of the plate 20 when it is moved to the position nearest to the wall 10A, i.e., for a letter size having a length L1 in the feeding direction D. FIG. 9 shows the position of the plate 20 when it is moved to the position farthest from the wall 10A, that is, for a legal size having a length L2 in the direction D. Accordingly, a cut sheet having a length between L1 shown in FIG. 8 and L2 shown in FIG. 9 can be accommodated in the container 10.

As shown in FIG. 5, two plates 30 are provided for guiding both side edges of the cut sheet in the direction D and placed on the container 10 to be symmetrical with each other about a center line of the container 10. Since both the construction and function of these two plates 30 are the same in this embodiment, one of two plates 30 will be explained as follows.

The plate 30 has the second wall 32 and a base section 33. The second wall 32 is formed at right angles to the base section 33, and extends in the direction D. The side edges of the cut sheets are slidingly contacted or supported by the second wall 32. The second wall 32 has enough height to accommodate many cut sheets, and blocks the movement of the cut sheets in the direction perpendicular to the direction D since the cut sheets are blocked by the second wall 32.

The plate 30 has a guide slit 31A extending in the direction perpendicular to the direction D. A pin 34 is fixed to the bottom plate 11 and inserted in the guide slit 31A. Accordingly, the plate 30 is guided so as to be moved in the direction perpendicular to the direction D. Note that the pin 34 and the guide slit 31A constitute a second restricting means of the present invention.

The base section 33 is mounted on a rest portion 11B formed on and protruded from the upper surface of the bottom plate 11. These permit the sliding movement of the plate 30 in the direction perpendicular to the direction D, but prohibit the movement in the direction D. The movement of the plate 30 in the direction perpendicular to the direction D is restricted to a range which is determined in accordance with the length of the guide slit 34.

Figure 6:
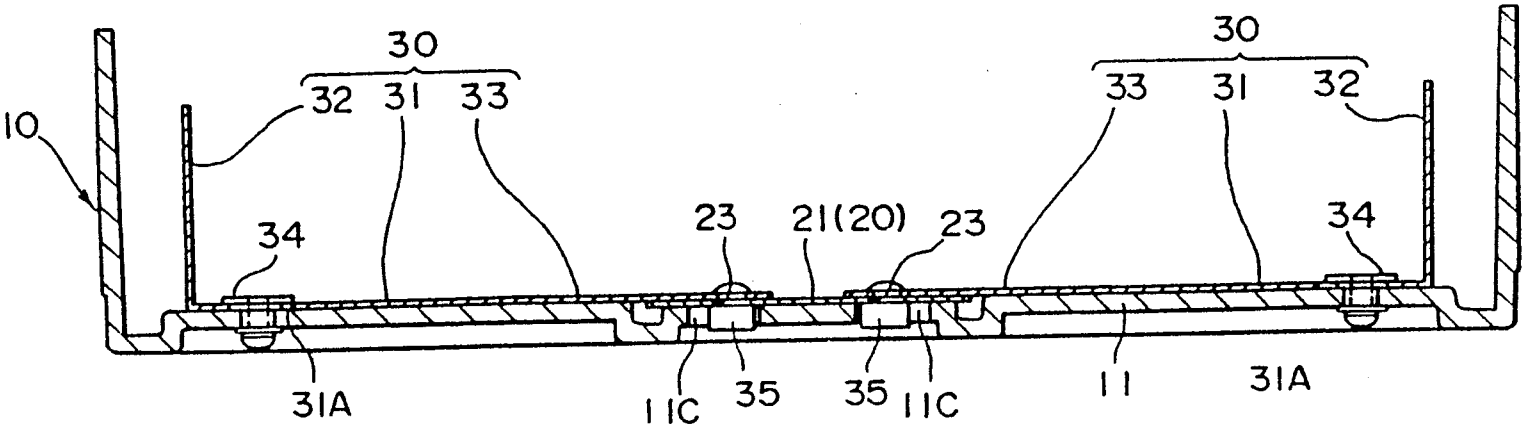
FIG. 6 is a cross-sectional view (along 6—6 of FIG. 5) of the sheet cassette.

A pin 35 is fixed to the bottom surface of the bottom plates 33. As shown in FIG. 6, the pins 35 are inserted in cam grooves 23 which are formed at the base sections 33, respectively. The paired cam grooves 23 are formed to be symmetrical with each other about a center line of the container 10, extending in the direction D. When the plate 20 is moved in the direction D, since the pins 35 are guided along the guide grooves 23, respectively, the plate 30 will be moved in accordance with the movement of the plate 20, in the direction perpendicular to the direction D.

Figure 7:
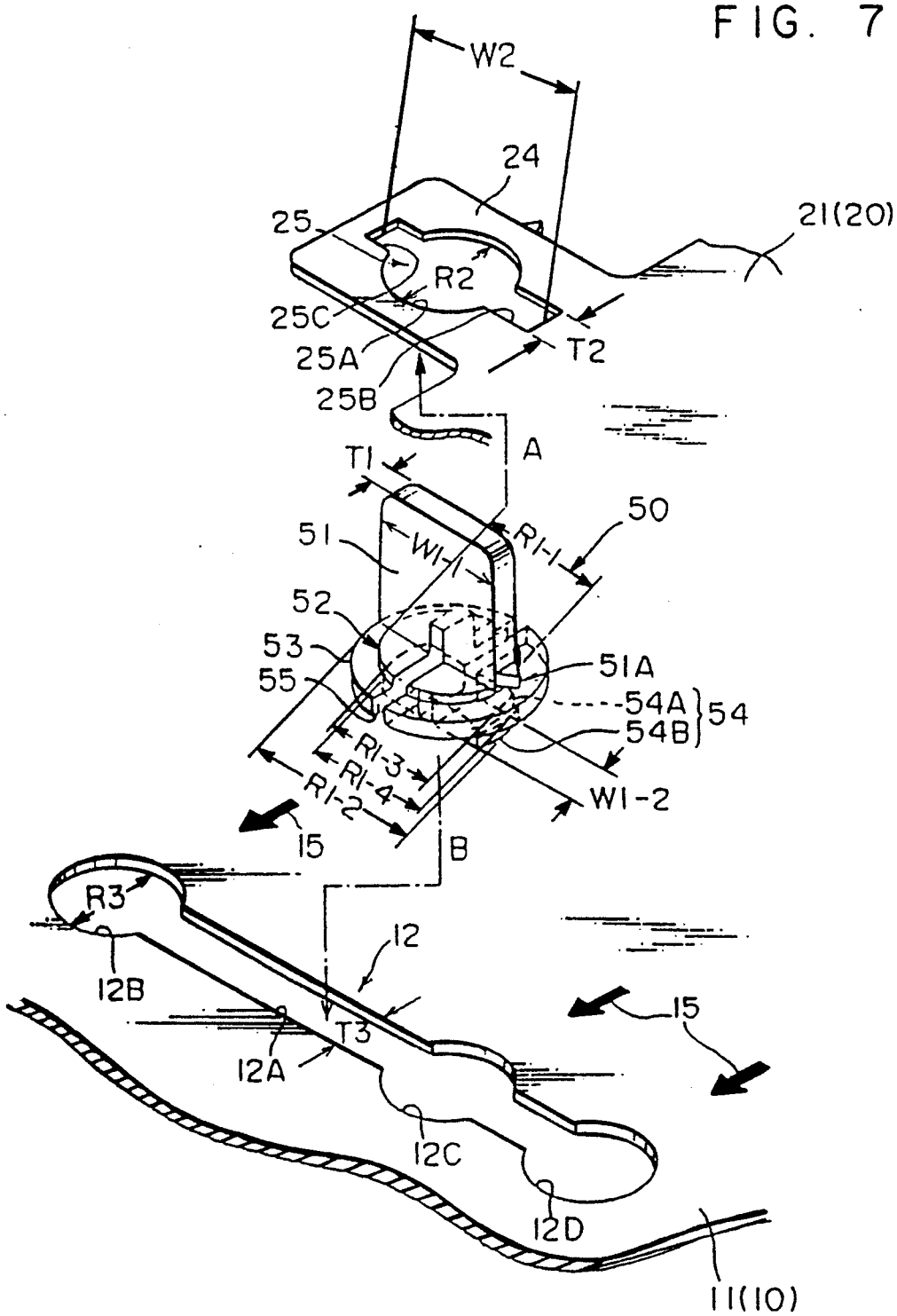
FIG. 7 is an exploded perspective view for illustrating a lock mechanism.

Hereinafter, a locking mechanism for locking the plate 20 in a desired position will be explained. As shown in FIG. 7 in which an enlarged view of the end section 24 of the plate 20 is indicated, the locking mechanism is provided with a knob 50 rotatably fitted to the end section 24 and a slit 12 which is formed on the bottom plate 11 and through which the bottom portion of the knob 50 is inserted. The end section 24 is located at the end of plate 20 between the two first walls 22. A hole 25 is formed in the end section 24 and has a round hole 25A, and slits 25B and 25C which extend in the direction D, as shown in FIG. 7. The knob 50 includes a grasp portion 51, a circular portion 52, which is integrally connected to the bottom of the grasp portion 51 and which is interfitted into the round hole 25A, a flange portion 53 which is integrally connected to the bottom of the circular portion 52 and which has a larger diameter than that of the round hole 25A, and an engagement portion 54 protruded from the bottom of the flange portion 53.

As shown in FIG. 7, the grasp portion 51 has a predetermined width W1−1 that is less than that W2 of the hole 25 in the direction D, and greater than the diameter R2 of the round hole 25A. The thickness T1 of the grasp portion 51 is less than the width T2 of the slits 25B and 25C.

The circular portion 52 has a round shape with a predetermined diameter R1−1 that is less than R2. The flange portion 53 has a round shape with a predetermined diameter R1−2 that is greater than R2.

When the knob 50 is inserted in the direction of the arrow A shown in FIG. 7, the top surface of the flange portion 53 contacts the bottom surface of the end section 24, since R1−2 is larger than R2. When the knob 50 is turned 90 degrees, the bottom surface of grasp portion 51 contacts the top surface of end section 24 since W1−1 wider than R2. Thus, the knob 50 is rotatably mounted on the end section 24.

The engagement portion 54 is provided with sections 54A and 54B. The sections 54A and 54B each have two straight side surfaces and two rounded surfaces. The length R1−3 of section 54A is less than diameters R3 of the holes 12B, 12C and 12D. The length R1−4 of section 54B is greater than R3. The widths W1−2 of the sections 54A and 54B are less than T3 of section 12A of the slit 12.

When the knob 50 is inserted in the slit 12 in the direction of arrow B as shown in FIG. 7, the bottom surface of flange portion 53 contacts the upper surface of the bottom plate 11 since T3 is greater than W1−2 and less than R1−2. Accordingly, in this condition, the knob 50 is movable in the longitudinal direction of slit 12, that is, in the direction D. When the knob 50 is in an area between the holes 12B and 12C, or between the holes 12C and 12D, it cannot be turned since R1−3 is greater than T3. When the knob 50 is in each of the holes 12B, 12C and 12D, it can be turned since R1−3 is less than R3. When the knob 50 is turned in each of the holes 12B, 12C and 12D, the top surface of the section 54B contacts the bottoms surface of plate 11 since R1−4 is larger than R3. Accordingly, when the knob 50 is turned, that portion of the bottom plate 11, which is around the hole 12B, 12C, or 12D, will be set between the flange portion 53 and the section 54B. Thus, the knob 50 is rotatably mounted on the bottom plate 11.

Therefore, if the grasp portion 51 is inserted as per arrows A and B, when the operator moves the knob 50 in the longitudinal direction of the slit 12, the plate 20 will be moved with the knob 50 relative to the bottom plate 11. When the operator turns the knob 50 in the holes 12B, 12C or 12D, its movement in the longitudinal direction will be restricted or locked since R1−3 is larger than T3.

In this embodiment, the position of the hole 12B is determined so as to correspond a legal-sized cut sheet. The position of the hole 12C is determined so as to correspond a A4-sized cut sheet. The position of the hole 12D is determined so as to correspond a letter-sized cut sheet.

Thus, the movement of the trailing end positioning plate 20 can be locked corresponding to the sizes used in the sheet cassette, that is, corresponding to legal size cut sheet, A4 sized cut sheet, and letter sized cut sheet.

It would be clear that the present invention is not limited to the embodiment described above, nor those illustrated in the drawings, and the invention can be modified without departing from the spirit and scope of the claimed invention.

The present disclosure relates to subject matters contained in Japanese Utility Model Application No. HEI 4-18414 (filed on Feb. 27, 1992) which is expressly incorporated herein by reference in its entirety.

What is claimed is:

1. A sheet cassette for accommodating cut sheets, detachably coupled to an apparatus, said sheet cassette comprising:

a cassette body in which the cut sheets are accommodated, an uppermost one of the cut sheets being successively picked up to said apparatus in a predetermined pick up direction;

first wall means for regulating a trailing edge of the cut sheet relative to said predetermined pick up direction, said first wall means being movable in said predetermined pick up direction; wherein said first wall means includes:

a first wall to which the trailing edge of the cut sheets is contacted; and first restricting means for restricting movement of said first wall in said predetermined pick up direction;

second wall means for regulating both side edges of the cut sheets in said predetermined pick up direction, said second wall means being movable in a direction perpendicular to said predetermined pick up direction; wherein said second wall means includes:

a pair of second walls to which the both side edges of the cut sheets are contacted, respectively; and second restricting means for restricting movement of paired second walls in a direction perpendicular to said predetermined pick up direction; and interconnecting means for interconnecting movement of said first wall means with that of said second wall means in a predetermined relation; wherein said interconnecting means includes:

a first connecting plate integrally formed to said first wall and extending in said predetermined pick up direction between said paired second walls;

a pair of second connecting plates integrally formed to said paired second walls, respectively, extending to the direction perpendicular to said predetermined pick up direction so as to be transverse to said first connecting plate;

a pair of cam grooves formed on said first connecting plate; and a pair of cam followers coupled to said paired second connecting plates, respectively, and inserted into said cam grooves, respectively;

wherein said paired second walls are moved in the direction perpendicular to said pick up direction in accordance with the movement of said first wall through a cam profile of said cam groove.

2. The sheet cassette according to claim 1, wherein said paired cam grooves are formed to be symmetrical with each other about a center line of said cassette body extending in said predetermined pick up direction.

3. The sheet cassette according to claim 1, which further comprises:

lock means for locking movement of said first wall means.

4. A sheet cassette for accommodating cut sheets, detachably coupled to an apparatus, said sheet cassette comprising:

a cassette body in which the cut sheets are accommodated, the uppermost one of the cut sheets being successively picked up to the apparatus in a predetermined pick up direction;

first blocking means for blocking movement of the cut sheets in a direction opposite to said predetermined pick up direction, movable with respect to said cassette body, said first blocking means including a first blocking plate to which a trailing edge of the cut sheets is contacted;

first restricting means for restricting movement of said first blocking means in said predetermined pick up direction;

second blocking means for blocking movement of the cut sheets in a direction perpendicular to said predetermined pick up direction, movable with respect to said cassette body, said second blocking means including a pair of second blocking plates to which both side edges of the cut sheets are respectively contacted;

second restricting means for restricting movement of said second blocking means in said perpendicular pick up direction; and interconnecting means for interconnecting movement of said first blocking means with that of said second blocking means in a predetermined relation, wherein said interconnecting means includes:

a first connecting plate integrally formed to said first blocking plate and extending in said predetermined pick up direction between said paired second blocking plates;

a pair of second connecting plates integrally formed to said paired second blocking plates, respectively, extending to the direction perpendicular to said predetermined pick up direction so as to be transverse to said first blocking plate;

a pair of cam grooves formed on said first connecting plate; and a pair of cam followers coupled to said paired second connecting plates, respectively, and inserted into said cam grooves, respectively;

wherein said paired second blocking plates are moved in the direction perpendicular to said predetermined pick up direction in accordance with movement of said first blocking plate through a cam profile of said cam grooves.

5. The sheet cassette according to claim 4, wherein said paired cam grooves are formed to be symmetrical with each other about a center line of said cassette body extending in said predetermined pick up direction.

6. The sheet cassette according to claim 4, which further comprises:

lock means for locking movement of said first blocking means.

7. A sheet cassette for accommodating cut sheets, detachably coupled to an apparatus, said sheet comprising:

a cassette body in which the cut sheets are accommodated, an uppermost one of the cut sheets being successively picked said apparatus in a predetermined pick up direction;

first positioning means for positioning a trailing of the cut sheet relative to said predetermined pick up said first positioning means being movable in said pick up direction; wherein said first positioning means a first wall to which the trailing edge of the cut sheets is contacted; and first restricting means for restricting movement of said first wall in said predetermined pick up direction;

second positioning means for positioning both side edges of the cut sheets in said predetermined pick up direction, second positioning means being movable in a direction to said predetermined pick up direction; wherein said second positioning means includes:

a pair of second walls to which both side edges of the cut sheets are contacted, respectively; and second restricting means for restricting movement of paired second walls in the direction perpendicular to said predetermined pick up direction; and interconnecting means for interconnecting movement of said first positioning means with that of said second means in a predetermined relation; wherein said means includes:

a first connecting plate integrally formed to said first wall and extending in said predetermined pick up direction said paired second walls;

a pair of second connecting plates integrally said paired second walls, respectively, extending to the perpendicular to said predetermined pick up direction, so as transverse to said first connecting plate;

a pair of cam grooves formed on said first connecting plate; and a pair of cam followers coupled to said paired second connecting plates, respectively, and inserted into said cam grooves, respectively;

wherein said paired second walls are moved in the direction perpendicular to said predetermined pick up accordance with movement of said cassette body extending in predetermined pick up direction.

8. The sheet cassette according to claim 7 wherein said paired cam grooves are formed to be symmetrical with each other about a center line of the cassette body extending in said pick up direction.

9. The sheet cassette according to claim 7, which further comprises:

lock means for locking movement of said first positioning means.

* * * * *

UNITED STATES PATENT AND TRADEMARK OFFICE

CERTIFICATE OF CORRECTION

PATENT NO. : 5,297,787

DATED : March 29, 1994

INVENTOR(S) : M. SHIRAI

It is certified that error appears in the above-indentified patent and that said Letters Patent is hereby corrected as shown below:

At column 7, line 24 (claim 7, line 2), change "sheet" to ---sheet cassette---.

At column 7, line 28 (claim 7, line 6), change "picked" to ---picked up to---.

At column 7, line 30 (claim 7, line 8), change "trailing" to ---trailing edge---.

At column 7, line 31 (claim 7, line 9), change "pick up" to ---pick up direction---.

At column 7, line 33 (claim 7, line 11), change "pick up" to ---predetermined pick up---.

At column 7, line 34 (claim 7, line 12), change "means" to ---means includes:---.

At column 8, line 3 (claim 7, line 20), change "second" to ---said second---.

At column 8, line 4 (claim 7, line 21), change "direction" to ---direction perpendicular---.

UNITED STATES PATENT AND TRADEMARK OFFICE

CERTIFICATE OF CORRECTION

PATENT NO. : 5,297,787
DATED : March 29, 1994
INVENTOR(S) : M. SHIRAI

It is certified that error appears in the above-indentified patent and that said Letters Patent is hereby corrected as shown below:

At column 8, line 14 (claim 7, line 31), change "second" to ---second positioning---.

At column 8, line 15 (claim 7, line 32), change "means" to ---interconnecting means---.

At column 8, line 19 (claim 7, line 36), change "integrally" to ---integrally formed to---.

At column 8, line 20 (claim 7, line 37), change "extending to the" to ---extending to the direction---.

At column 8, line 22 (claim 7, line 39), change "so as" to ---so as to be---.

At column 8, line 30 (claim 7, line 47), change "accordance" to ---direction in accordance---.

At column 8, line 31 (claim 7, line 48), change "predetermined" to ---said predetermined---.

Signed and Sealed this

Eighth Day of October, 1996

*Attest:*

*Attesting Officer*

Bruce Lehman

BRUCE LEHMAN

*Commissioner of Patents and Trademarks*